US005624183A

United States Patent [19]

Schuff

[11] Patent Number: 5,624,183

[45] Date of Patent: Apr. 29, 1997

[54] APPARATUS FOR METERING AND MIXING AGGREGATE AND CEMENT

[76] Inventor: David A. Schuff, 420 S. 19th Ave., Phoenix, Ariz. 85009

[21] Appl. No.: 422,858

[22] Filed: Apr. 17, 1995

Related U.S. Application Data

[63] Continuation-in-part of Ser. No. 234,934, Apr. 28, 1994, abandoned, which is a continuation of Ser. No. 38,238, Mar. 29, 1993, abandoned.

[51] Int. Cl.[6] ..... B28C 5/14; B28C 7/10

[52] U.S. Cl. ..... 366/20; 366/22; 366/32; 366/35; 366/66

[58] Field of Search ..... 366/16, 20, 21, 366/33, 35, 37, 38, 66, 177.1, 181.1, 181.3, 182.1, 319, 22, 325.1, 32

[56] References Cited

U.S. PATENT DOCUMENTS

| | | | |
|---|---|---|---|
| 156,351 | 10/1874 | Hulett et al. | 366/319 X |
| 475,618 | 5/1892 | Skinner | 366/35 X |
| 974,588 | 11/1910 | Olp | 366/33 X |
| 1,462,649 | 7/1923 | MacLellan | 366/181 X |
| 2,703,704 | 3/1955 | Wylie | 366/24 |
| 3,066,615 | 10/1962 | Mason, Jr. | 366/20 |
| 3,130,070 | 4/1964 | Potters et al. | 366/319 X |
| 4,071,226 | 1/1978 | Miller | 366/35 X |
| 4,117,547 | 9/1978 | Mathis et al. | 366/33 X |
| 4,190,370 | 2/1980 | Brock et al. | 366/25 |
| 4,223,996 | 9/1980 | Mathis et al. | 366/319 X |
| 4,318,619 | 3/1982 | Schlarmann | 366/25 X |
| 4,427,297 | 1/1984 | Stastny | 366/33 X |
| 4,624,575 | 11/1986 | Lantz | 366/16 |
| 4,855,960 | 8/1989 | Janssen et al. | 366/33 X |

FOREIGN PATENT DOCUMENTS

| | | | |
|---|---|---|---|
| 268991 | 6/1988 | European Pat. Off. | 366/16 |
| 290226 | 1/1912 | Germany | 366/21 |
| 2115711 | 9/1983 | United Kingdom | 366/22 |

*Primary Examiner*—Charles E. Cooley
*Attorney, Agent, or Firm*—H. Gordon Shields

[57] ABSTRACT

Portable metering and mixing apparatus includes a trailer having a hopper thereon divided into two compartments, one compartment for aggregate and another compartment for cementitious material. An auger receives aggregate from one compartment and feeds aggregate into a mixing compartment where cementitious material is added, and the resulting mixture is then delivered as required. Metering elements meter the aggregate and the cementitious material as desired, and the metered aggregate and cementitious material are mixed in a mixing chamber. A metering sleeve over the auger insures that only the metered amount of aggregate is conveyed by the auger to the mixing chamber. A second embodiment utilizes only a single hopper which contains premixed aggregate and cementitious material, and the premix is fed to the auger through a metering sleeve. Water is added to the material while in the auger and prior to the mixing chamber. Heat may be used to heat or warm both the water used for mixing and the material to be mixed. The trailer may also be leveled or lifted, as desired.

13 Claims, 6 Drawing Sheets

APPARATUS FOR METERING AND MIXING AGGREGATE AND CEMENT

CROSS-REFERENCE TO RELATED APPLICATION

This application is a continuation-in-part application of Ser. No. 08/234,934, filed Apr. 28, 1994, now abandoned, which was a continuation application of Ser. No. 08/038,238, filed Mar. 29, 1993, now abandoned.

BACKGROUND OF THE INVENTION

1. Field of the invention

This invention relates to mixing apparatus and, more particularly, to a portable mixing apparatus in which aggregate and or cementitious material, water, and additive material may be maintained separately from each other at a job site until it is desired that the ingredients be mixed together in a desired blend and quantity.

2. Description of the Prior Art

U.S. Pat. No. 4,855,960 (Janssen et al) discloses a silo apparatus in which cementitious material and aggregate may be mixed at a job site. The silo may be transported to a job site on a trailer and then the mixer is removed from the trailer and left at the job site, freeing the trailer for further use. The silo includes separate compartments for cementitious material and for aggregate. The cementitious material, and aggregate and water are appropriately blended and mixed at the job site.

The silo concept may be suitable for large construction jobs where a substantial amount of the desired product is needed. However, such is not practical for small or medium sized construction jobs.

The alternative to a silo is simply the common mixer which is hauled to the job site, along with aggregate and cementitious material, etc.

One of the problems with prior art apparatus is the wide variation in quantities of aggregate conveyed by augers, such as in the '960 (Jansen et al) apparatus to be mixed with cementitious material. The problem stems from aggregate falling onto the auger and past the auger directly into the mixing chamber. The aggregate thus essentially bypasses the auger and the quantitative control afforded by the auger.

The problem discussed in the preceding paragraph is alleviated in the present invention by the provision of a metering sleeve adjacent to the mixing chamber and over and around or about a portion of the auger. The metering sleeve insures that the aggregate is metered to the mixing chamber by the auger.

The apparatus of the present invention overcomes the shortcomings of the prior art by providing a portable, trailer mounted unit in which the basic ingredients of aggregate and or cementitious may be placed in separate compartments and the unit may then be hauled to a construction site by a pickup truck. At the site, a suitable water supply may be connected to the unit and the cementitious material and aggregate and water may be appropriately mixed as desired. The product is accordingly only mixed as needed, and the dry ingredients may be maintained indefinitely until the mixed product, stucco, plaster, grout, etc., is needed.

The basic ingredients of aggregate and or cementitious material will be referred to herein. It will be obvious that other ingredients may be added to the basic ingredients in accordance with the desired product. Such is well known and understood in the art.

SUMMARY OF THE INVENTION

The invention described and claimed herein comprises a trailer unit having a hopper divided into two hoppers or compartments, a hopper or compartment for aggregate and a hopper or compartment for or cementitious material. An auger is disposed beneath the aggregate hopper, and the aggregate is moved by the auger into a mixing compartment. A metering sleeve about the auger mixing blades in the mixing compartments is on a shaft coaxially aligned with the auger. Water is mixed into the aggregate as it moves by the auger into the mixing compartment. Cementitious material is delivered directly to the mixing compartment and is appropriately mixed with the moistened aggregate. The mixed product is then delivered from the mixing compartment on an as needed basis. The mixture of both the water and the ratio between the cementitious material and aggregate may be controlled to provide the desired blend.

A second embodiment discloses only a single hopper for pre-mixed ingredients. The mixing of water with the pre-mixed dry material is accomplished at the job site.

Among the objects of the present invention are the following:

To provide new and useful mixing apparatus;

To provide new and useful portable mixing apparatus;

To provide new and useful concrete mixing apparatus in which the ratio of cementitious material to aggregate may be carefully controlled;

To provide new and useful portable concrete mixing apparatus in which a premixed dry cementitious material and aggregate mixture may be transported to a job site and then mixed with water at the jobsite;

To provide new and useful mixing apparatus in which a metering sleeve is disposed about a feed screw or auger for measuring material fed to the screw from a hopper;

To provide cementitious material mixing apparatus in which water is delivered to aggregate prior to the delivery of the cementitious material to the aggregate for appropriate mixing; and To provide new and useful portable mixing apparatus in which agitating elements for delivering cementitious material includes arms having a fixed portion and a flexible portion.

DESCRIPTION OF THE PREFERRED EMBODIMENT

Figures 1, 3, 4:
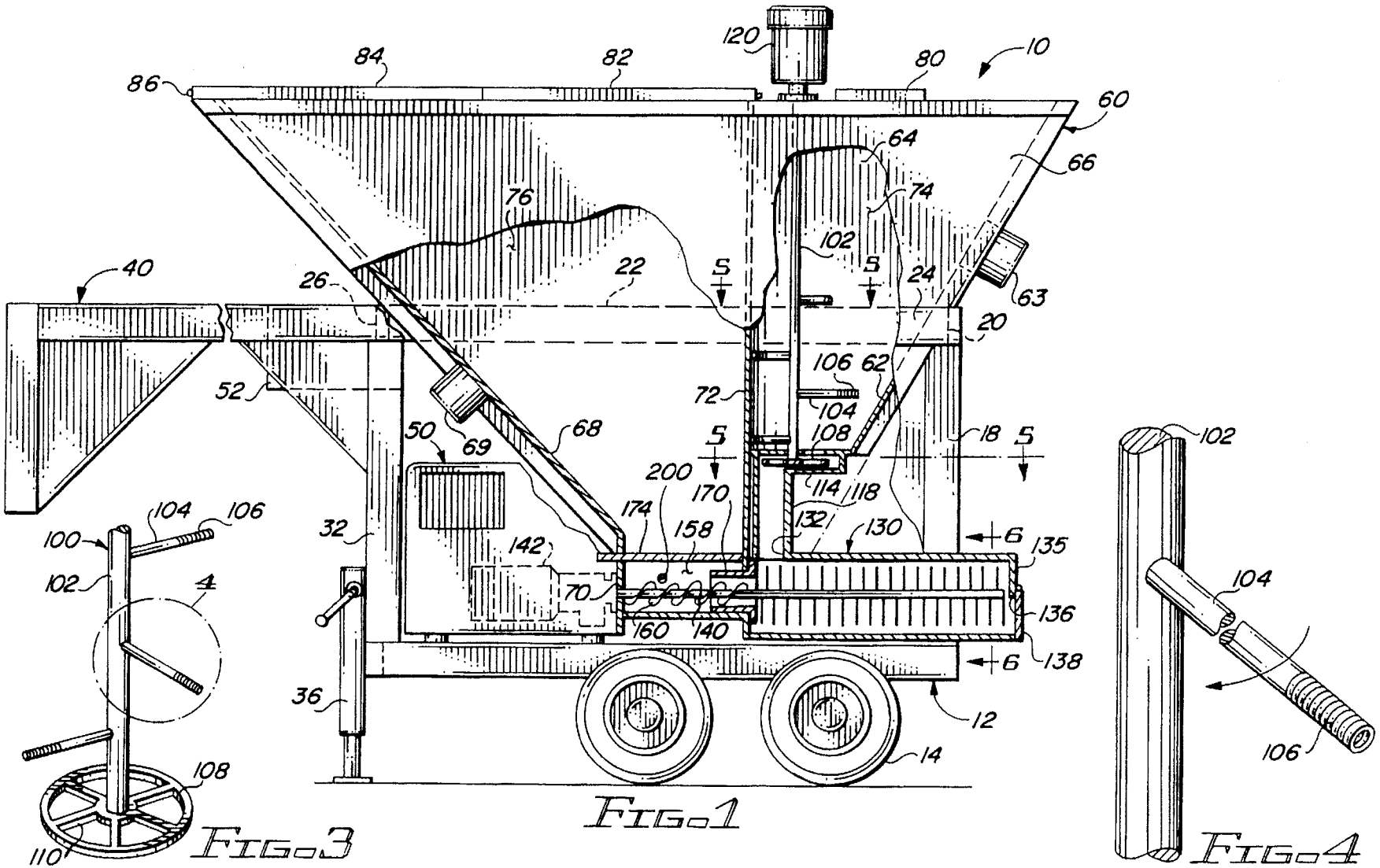
FIG. 1 is a view in partial section of apparatus embodying the present invention.
FIG. 3 is an enlarged perspective view of a portion of the apparatus of the present invention.
FIG. 4 is an enlarged perspective view taken generally from circle 4 of FIG. 3.
Figure 2:
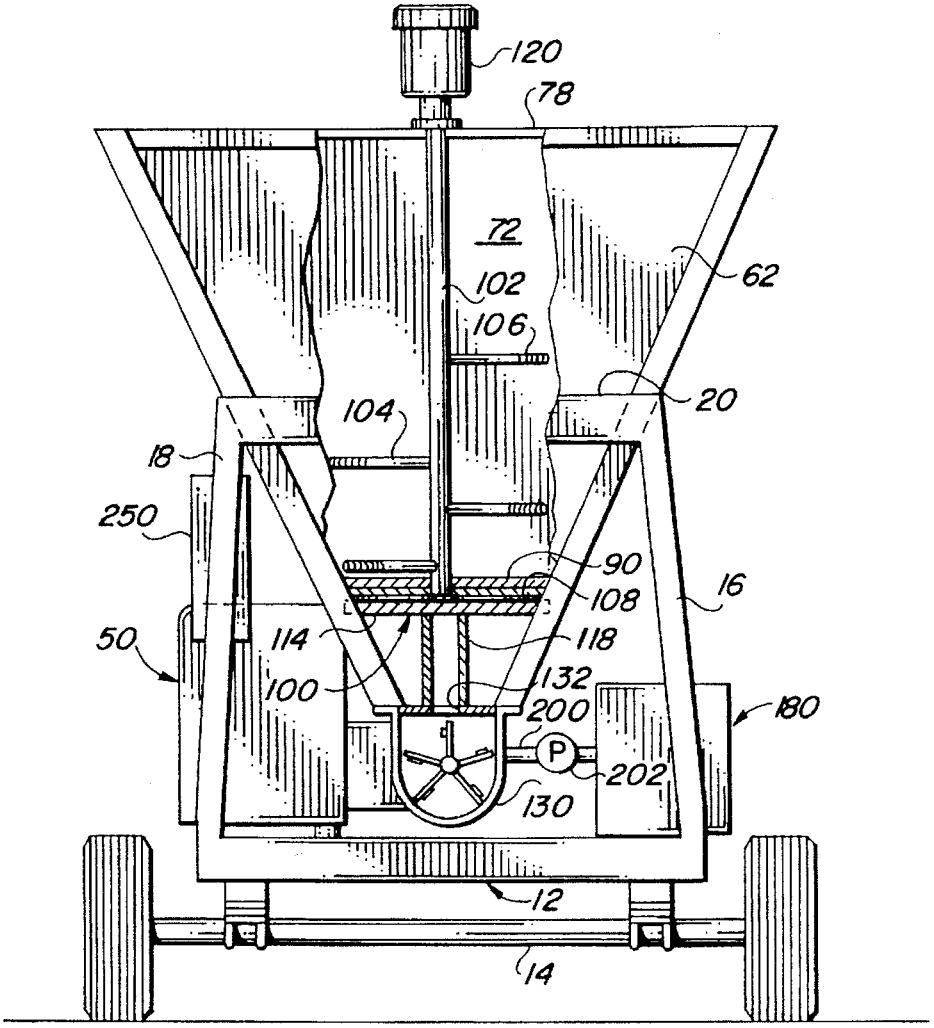
FIG. 2 is a view in partial section of a portion of the apparatus of FIG. 1.

FIG. 1 is a side view in partial section of mixer apparatus 10 of the present invention. FIG. 2 is a rear end view, with a portion broken away, and in partial section, of a portion of the mixer apparatus 10 shown in FIG. 1. For the following general discussion, reference will primarily be made to FIGS. 1 and 2. Other figures will be referenced as appropriate.

The mixer apparatus 10 includes a bottom, generally rectangular support frame or undercarriage 12 to which is secured running gear which includes a pair of dual axles and wheels 14. At the rear of the apparatus 10 are rear vertical frame members 16 and 18. The rear vertical frame members 16 and 18 are secured at their upper portion to an upper transverse horizontal frame member 20.

Extending forwardly from the frame member 16 and 18 are longitudinal frame members 22 and 24. The frame members 22 and 24 are appropriately secured to the rear vertical frame member 16 and 18, respectively, and to the rear horizontal and transverse frame member 20.

The longitudinal frame member 22 and 24 extend forwardly to a front transverse and horizontally extending frame member 26 and to a pair of front vertically extending members which are generally parallel to the frame members 16 and 18. The front vertically extending frame members include a frame member 32. The frame member 32 comprises a left front vertical frame member and is shown in FIG. 1.

There is also a center front vertical frame member, not shown, which extends between the frame 12 and the upper front transverse or horizontal frame member 26.

Extending downwardly from the frame 12 is a leveling jack 36. The purpose of the leveling jack 36 is to level the mixer apparatus 10 at a construction site or wherever the apparatus 10 is put into use.

Extending forwardly from the various front frame members is a tongue assembly 40. The tongue assembly 40 is designed to be used as a fifth wheel connection for a tractor, pickup, etc.

An engine compartment 50 is appropriately secured to the bottom support frame or undercarriage 12 for providing the desired power for the various elements involved in the mixer apparatus 10. The engine compartment 50 may include a diesel engine which provides power for a pump for hydraulic motors. A hydraulic tank 52 is illustrated in FIG. 1 disposed above the engine compartment 50 and appropriately secured to the various front frame members.

Disposed on the undercarriage 12, and within the various frame members as discussed above, is a hopper assembly 60. Essentially, the support frame 12 and the vertical, transverse, and longitudinal frame members comprise or define a cradle for supporting the hopper assembly 60.

The hopper assembly 60 is divided into two portions, one portion or chamber for receiving cementitious material and a second portion or chamber for receiving aggregate.

The hopper assembly 60 includes generally four sloping walls, as may be understood from FIGS. 1 and 2. The hopper assembly 60 also includes a number of structural elements or members generally at the four corners and at the top and bottom of the hopper assembly 60. The structural elements are appropriately secured to the various panels or walls which comprise the hopper assembly and also to the various supporting frame members referred to above.

The hopper assembly 60 includes a rear sloping wall 62, a right side sloping wall 64, a left side sloping wall 66, and a front sloping wall 68. The sloping walls are generally in the form of an inverted pyramid in that the walls taper inwardly from their upper portions. Or, in reverse phraseology, the sloping walls taper upwardly and outwardly from their bottom portions.

A partition 72, which extends generally vertically and transversely between the side wall 64 and 66, divides the hopper assembly 60 into two portions or chambers, a rear cementitious material hopper or chamber 74 and a front aggregate hopper or chamber 76.

A top cover panel 78 closes the cementitious material hopper or chamber 74. There is a cementitious material filling port cover 80 which is secured to the top cover 78 covering a cementitious material filling port. The cementitious material port cover 80 helps to make certain that rain, and the like, does not inadvertently fall into the cementitious material chamber 74.

Figure 1A:
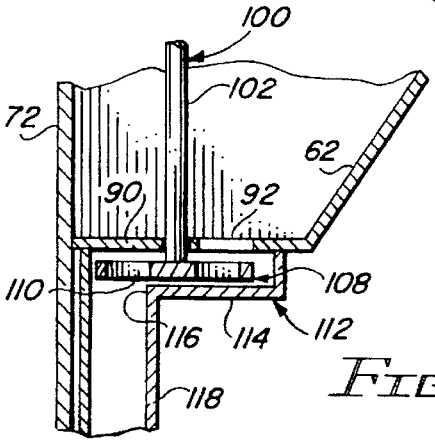
FIG. 1A is an enlarged view in partial section of a portion of FIG. 1.

The bottom of the cementitious material chamber 74 is closed by a bottom wall 90, best shown in FIG. 1A. FIG. 1A is an enlarged view of the lower portion of the cementitious material chamber 74 and elements associated therewith, as will be discussed below. The bottom wall 90 extends between the two side walls 64 and 66 and between the lower portion of the rear sloping wall 62 and the partition 72.

Within the chamber 74 is a vane feeder agitator assembly 100. The agitator assembly 100 agitates the cementitious material in the chamber 74 to help the cementitious material move by gravity downwardly into a vane assembly 108 through an opening 92 in the bottom wall 90 of the chamber 74.

The opening 92 in the bottom wall 90 in the cementitious material chamber communicates with a vane feeder housing 112. The housing 112 is connected to a chute 118 which extends to a mixing chamber 130. The vane assembly 108 is disposed in the housing 112.

Figure 6:
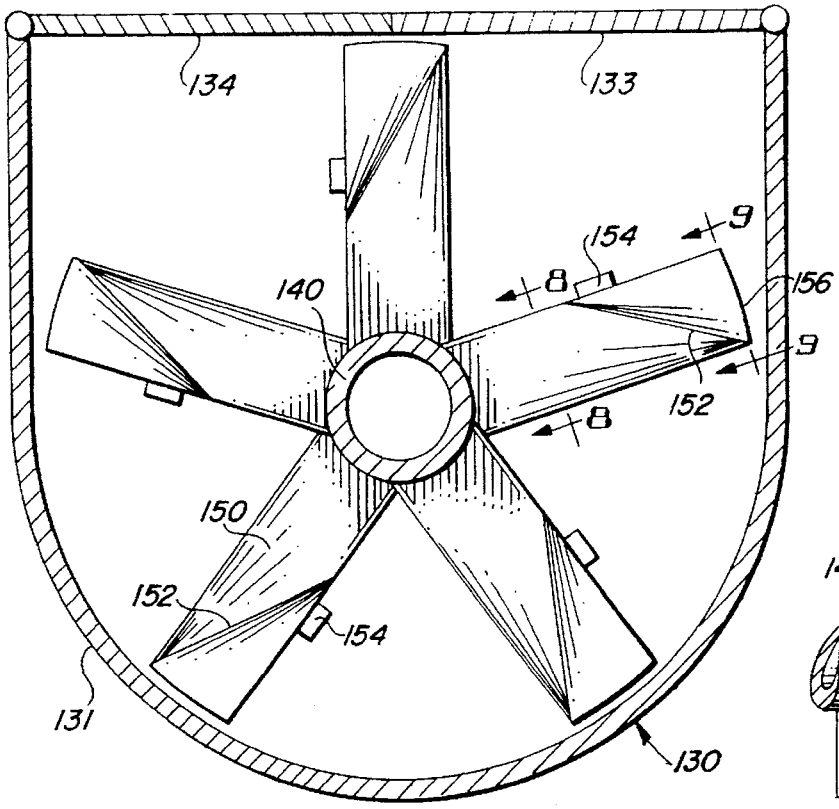
FIG. 6 is a view in partial section taken generally along line 6—6 of FIG. 1.

The mixing chamber 130 is a generally elongated U-shaped chamber in which cementitious material is mixed with aggregate and water. The U configuration is best shown in FIG. 6, which is a view in partial section through the chamber 130 and taken generally along line 6—6 of FIG. 1. A cementitious material opening 132 extends through the top rear portion of the mixing chamber 130 to communicate with the chute 118. The mixing chamber 130 receives the cementitious material from the chute 118 through the opening 132.

As may be seen from FIG. 1, the aggregate chamber 76 is substantially larger than the cementitious material chamber 74. The aggregate chamber 76 is defined by the side walls 64 and 66, the partition 72, and the front sloping end wall 68.

A vibrator 63 is appropriately secured to the rear sloping wall 62. A vibrator 69 is appropriately secured to the sloping wall 68. The purpose of the vibrators 63 and 69 is to insure that the cementitious material in the chamber 74 and the aggregate in the chamber 76 flow downwardly to the lower portions of their respective chambers and then downward for mixing, etc., as described.

At the bottom of the aggregate hopper or chamber 76 is a aggregate feed chamber 158 into which the aggregate flows or drops from the hopper or chamber 76. Details of the chamber 158 are shown best in FIGS. 1, 13, 14 and 15. The aggregate feed chamber 158 includes two end walls, including a front end wall 70 and a generally parallel end wall or plate 139, (see FIG. 13) which essentially comprises the bottom of the partition 72. The end wall 70 extends downwardly from the sloping side wall 68. At the bottom of the aggregate feed chamber 158 is an auger 160. The auger 160 which will be discussed in detail below in conjunction with FIGS. 1, 13, 14, and 15.

The top of the aggregate hopper or chamber 76 is closed or covered by movable panels, two of which, panels 82 and 84, are shown in FIG. 1. The panels 82 and 84 appropriately move on a horizontally extending rod 86 which is appropriately secured to supporting frame members at the top of the hopper assembly 60. The top cover panels provide access to the aggregate chamber 76 for filling and cleaning purposes.

Figure 5:
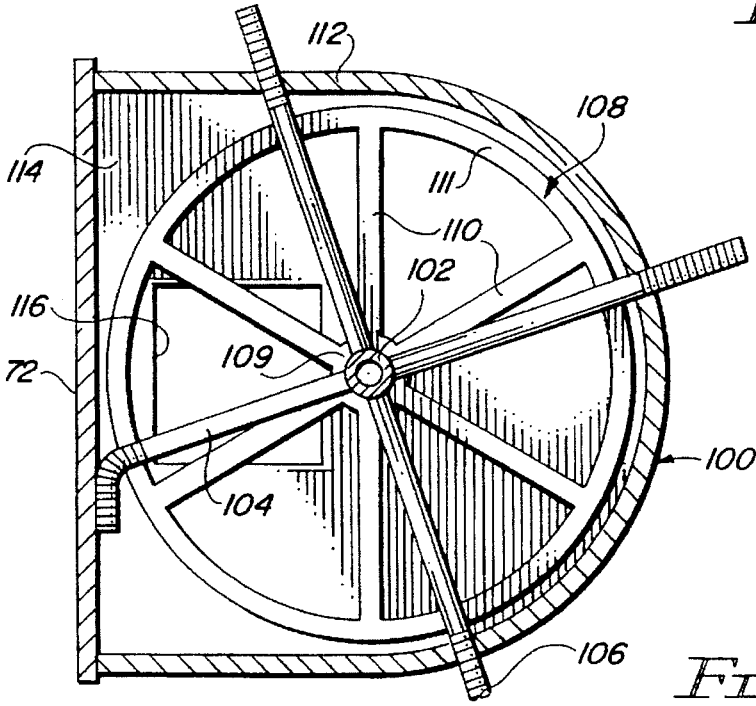
FIG. 5 is an enlarged view taken generally along line 5—5 of FIG. 1.

The movement and metering of the cementitious material in the cementitious material chamber 74 is accomplished by the vane feeder assembly 100. Details of the vane feeder assembly 100 are shown in FIGS. 1, 1A, 2, 3, 4, and 5. FIG. 1A is an enlarged side view of a portion of the vane feeder assembly 100. FIG. 3 is a perspective view of a portion of the vane feeder assembly 100. FIG. 4 is an enlarged perspective view of a portion of the vane feeder assembly 100, taken generally from circle 4 of FIG. 3. FIG. 5 is a top view looking downwardly in the below the bottom plate 90 of the cementitious material chamber 74 at a portion of the vane feeder assembly 100. FIG. 5 is taken generally along line 5—5 of FIG. 1. For the following discussion regarding the vane feeder assembly 100, reference will be made to FIGS. 1A, 3, 4, and 5, in addition to FIGS. 1 and 2.

The vane feeder assembly 100 includes a shaft 102 to which are secured a plurality of agitating arms 104 and a vane feeder rotor 108. The rotor 108 is at the bottom of the shaft 102. The upper end of the shaft 102 extends through an appropriate bearing assembly in the top wall 78 and to a variable speed motor 120. The motor 120 may preferably be a hydraulic motor.

The shaft 102 and the mixing or agitating arms 104 disposed in the hopper or chamber 74. The agitating arms 104 include springs 106 on their outer or distal ends. The shaft 102 extends from the motor 112 to the rotor 108. The rotor 108 is disposed within the housing 112 beneath the bottom wall 90. The rotor 108 comprises a center hub 109 and a generally circular rim 111. A plurality of spokes 110 extend between the rim 111 and the center hub 109. The shaft 102 is appropriately secured to the center hub 109. The spokes 110 define, with the rim 111 and the hub 109, a plurality of pie shaped openings which receive cementitious material from the opening 92 in the bottom wall 90 of the chamber 74.

Beneath the rotor 108 is a plate 114. The plate 114 is the bottom wall of the housing 112 of the feeder assembly 100. The plate 114 includes an opening 116 through which the cementitious material drops into the chute 118 and on into the mixing chamber 130.

As the rotor 108 rotates, cementitious material falls through the opening 92 onto the plate 114 between the spokes 110 of the rotor 108. As the rotor moves, the cementitious material is moved along the plate 114 to the opening 116.

The shaft 102 is disposed adjacent to the opening 92 at the bottom wall 90 of the cementitious material hopper or chamber 74. The shaft 102 is accordingly reasonably close to the partition 72. The purpose of the spring outer ends 106 on the arms 104 is to provide maximum length for the agitating arms 104 and yet allow the arms to rotate relatively close to the partition 72. This is best illustrated in FIG. 5. When the outer ends 106 contact the partition 72, they bend to allow the shaft 102 and the arms 104 to continue to rotate. Once the spring outer ends clear the partition 72, they return to their normal elongated orientation, which is axially aligned with the agitating arms 104. The outer ends 106 comprise an extension of the arms 104 for agitating purposes.

As shown in FIGS. 1 and 2 and 3, the arms 104 are spaced apart vertically and angularly along the shaft 102.

The amount of cementitious material which flows from the hopper or chamber 74 into the housing 112 and the chute 118 and, ultimately, into the mixing chamber 130, depends on the size of the opening 92 in the wall 90 and the size of the openings in the rotor 108, which are both fixed, and the rotational speed of the shaft 102. The rotational speed of the shaft 102 is variable, and as it increases, more cementitious material flows downwardly through the chute 118 in a given length of time than will flow at a lower rotational speed of the shaft 102.

The motor 120 is, of course, a variable speed motor, as indicated above. The speed of the motor 120 is appropriately determined and controlled by an operator of the mixer apparatus 10.

Details of the mixing chamber 130 are shown in FIGS. 1, 2, 6, and 13. The mixing chamber 130 comprises a generally elongated U-shaped trough, as discussed above, in which is disposed a shaft 140. At one end of the mixing chamber 130 is the cementitious material opening 132 at the bottom of the chute 118. Cementitious material falls through the chute 118 and through the opening 132 and into the mixing chamber 130.

The mixing chamber 130 is closed at the top by a pair of panels 133 and 134. The panels 133 and 134 provide access for cleaning the chamber 130 and associated elements therein, as discussed below.

At the distal or outer end of the mixing chamber 130, remote from the opening 132, is an end plate 135. A dump opening 136 extends through the end plate 135. The dump opening 136 is controlled by a closure element or door 138. The door 138 is appropriately secured to the plate 135.

Remote from the end plate 135 is the front end plate 139. See FIG. 13. The end plate 139 extends downwardly from the partition 72.

Figure 7:
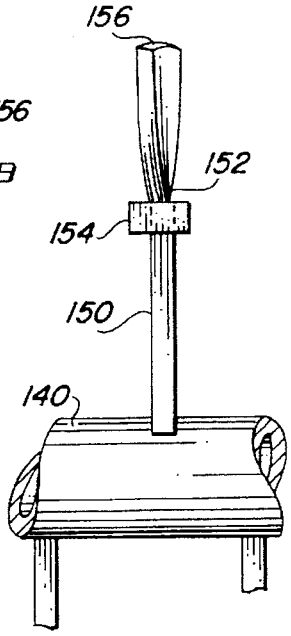
FIG. 7 is a side view of a portion of the apparatus of FIG. 6.
Figure 8:
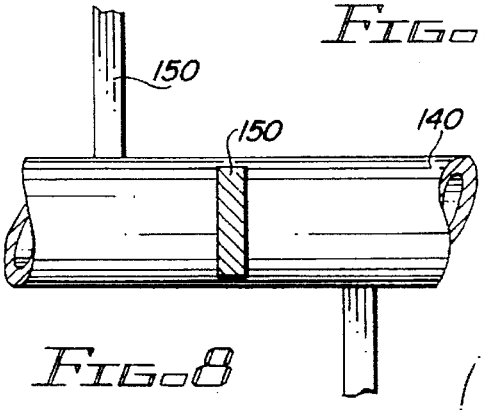
FIG. 8 is a view in partial section taken generally along line 8—8 of FIG. 6.
Figure 10:
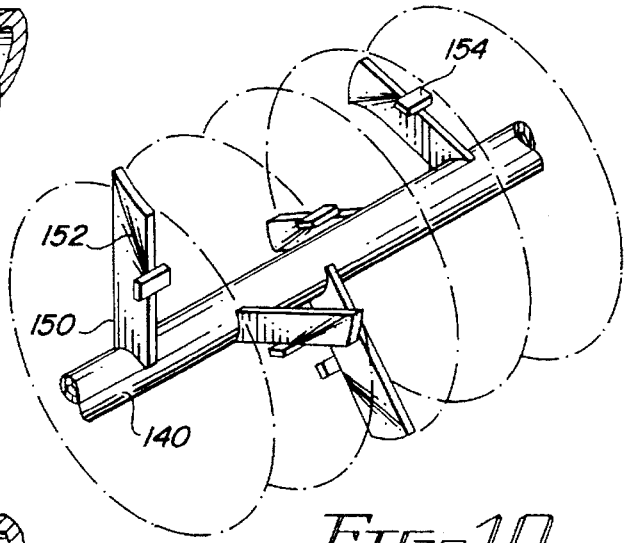
FIG. 10 is a perspective view of a portion of the apparatus of FIG. 6.
Figure 9:
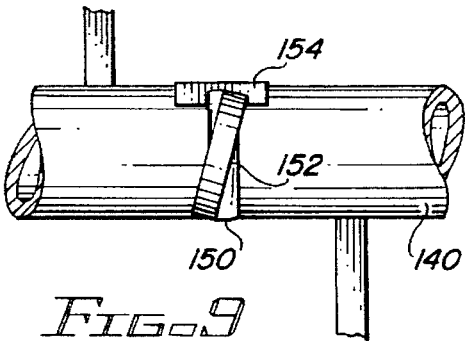
FIG. 9 is a fragmentary view taken generally along line 9—9 of FIG. 6.
Figure 13:
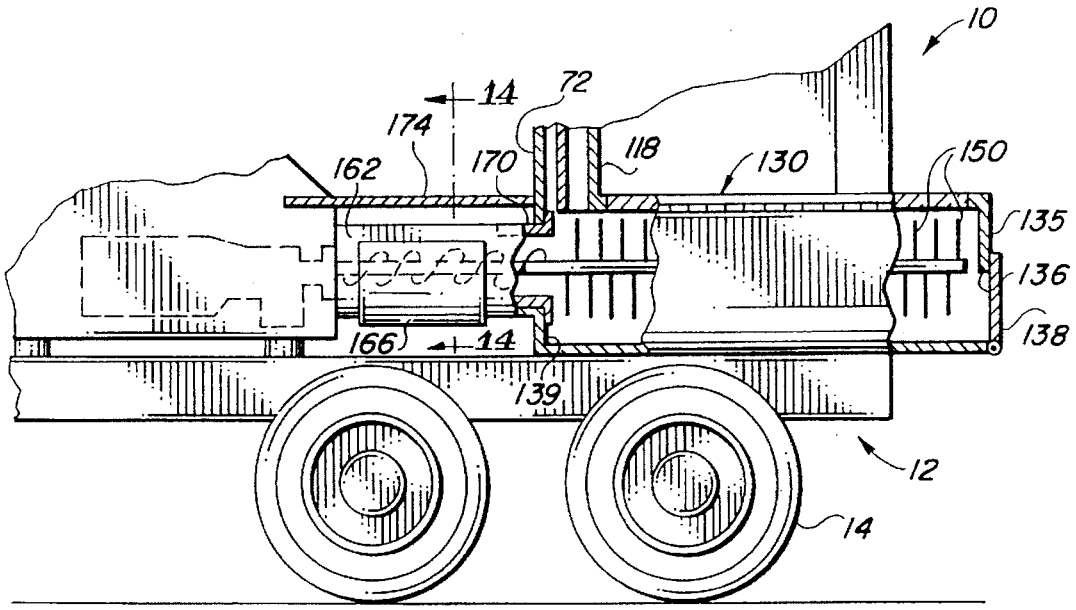
FIG. 13 is an enlarged view in partial section of a portion of the apparatus of FIG. 1.

For mixing cementitious material and aggregate, a plurality of blades 150 are secured to the shaft 140. Details of the blades 150 as secured to the shaft 140 are illustrated in FIGS. 6, 7, 8, 9, and 10. FIG. 6 is a view in partial section taken generally along line 6—6 of FIG. 1. FIG. 7 is a side view of a portion of the shaft 140. FIG. 8 is a view in partial section taken generally along line 8—8 of FIG. 6, and FIG. 9 is a fragmentary view taken generally along line 9—9 of FIG. 6. FIG. 10 is a perspective view illustrating the rotation of the shaft 140 and the blades 150 secured thereto. For the following discussion, reference will primarily be made to FIGS. 6–10, in addition to FIGS. 1, 2, and 13. FIG. 13 is an enlarged view in partial section of a portion of the apparatus of FIG. 1.

The shaft 140 is coaxially disposed within the mixing chamber 130. The blades 150 are secured to the shaft 140. The mixing blades 150 extend generally radially outwardly from the shaft 140. Each blade 150 includes a twist 152 to enhance the mixing and propelling action of the blades as the shaft 140 rotates. The twist 152 imparts a rearward (to the right as shown in FIG. 1) propelling force to the mixture as the shaft 140 rotates.

An aerator paddle 154 is secured to each blade 150 adjacent to the twist. The aerator paddles 154 are generally parallel to the longitudinal axis of the shaft 140. Accordingly, as the shaft 140 rotates, the aerator paddles 154 essentially slap the cementitious material and aggregate mixture or blend to help entrain air in the material being mixed.

Each blade 150 includes an outer end 156 which is disposed relatively close to the inner periphery of the mixing chamber 130. This is best shown in FIG. 6. The longer the blades 150 in relation to the "diameter" of the mixing chamber 130, the better will be the blending and mixing, of course.

As shown in FIG. 10, and as may also be understood from FIGS. 6, 7, 8, and 9, the blades 150 are spaced apart along the longitudinal length of the shaft 140. The seeming random location of the arms 150 insures relatively smooth mixing action as the shaft 140 rotates.

As shown in FIG. 6, there is an overall alignment or spacing between the arms or blades 150 to insure that the mixing action of the cementitious material and the aggregate is relatively smooth for maximum efficiency.

Returning to FIGS. 1 and 13, it will be noted that the shaft 140 extends not only through the mixing chamber 130, but also through the aggregate feed chamber 158 beneath the aggregate chamber 76. The shaft 140 is appropriately secured to a motor assembly 142 adjacent to the chamber 158. The motor 142 is preferably a hydraulic motor. The motor 142 is also a variable speed motor so that the speed of the shaft 140 may be appropriately varied, as desired, for metering purposes.

A metering sleeve 170 extends into the chamber 158 adjacent to the mixing chamber 130. The metering sleeve 170 is disposed about a portion of the auger 160 in the chamber 158.

Figure 14:
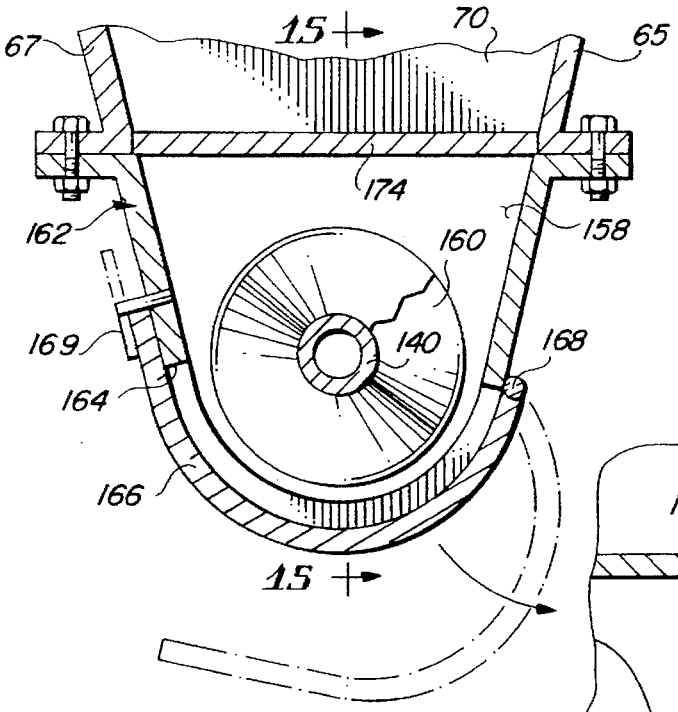
FIG. 14 is a view in partial section taken generally along line 14—14 of FIG. 13.
Figure 15:
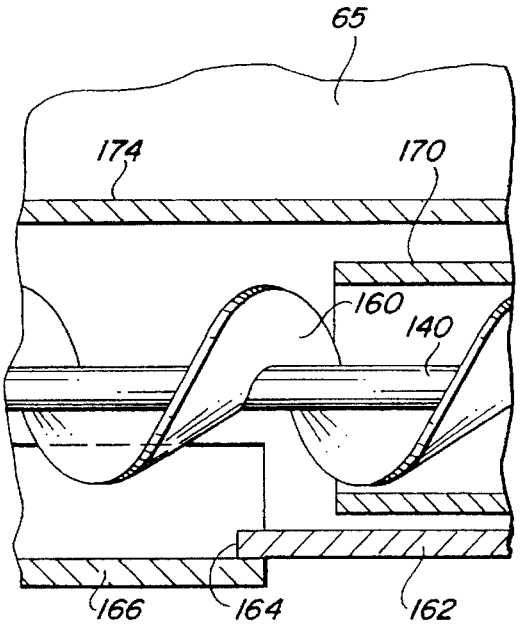
FIG. 15 is an enlarged view in partial section of a portion of FIG. 13.

Details of the metering sleeve 170 are shown in FIGS. 13, 14, and 15, in addition to FIG. 1. FIG. 13 is an enlarged view in partial section of a portion of the apparatus 10 of FIG. 1, as indicated above, showing the mixing chamber 130 and the metering sleeve 170 and associated elements. FIG. 14 is a view in partial section through the metering sleeve 170, the auger 160, and the shaft 140, taken generally along line 14—14 of FIG. 13. FIG. 15 is an enlarged side view in partial section taken generally along line 15—15 of FIG. 14 through the metering sleeve 170, the auger 160, and the shaft 140. For the following discussion reference will primarily be made to FIGS. 1, 13, 14, and 15.

The auger blade 160 is secured to the shaft 140 in an auger housing 162 beneath the aggregate hopper or chamber 76. The housing 162 includes outwardly extending flanges which are secured to outwardly extending flanges on the side walls 65 and 67 of the hopper assembly 60, as shown in FIG. 14. The housing 162 is a generally V-shaped trough with a rounded bottom, through which the auger 160 and the shaft 140 extend. The housing 162, with the end walls 70 and 139, defines the aggregate feed chamber 158.

There is a bottom cleanout opening 164 on the housing 162. The opening 164 is closed by a door 166. The door 166 is pivotally secured to the housing 162 by a hinge 168. Opposite the hinge 168, the door 166 has a lock handle 169 to secure the door to the housing 162.

The metering sleeve 170 is located at the end of the housing 162 adjacent to the mixing chamber 130. The metering sleeve 170 extends into the aggregate feed chamber 158 and is disposed about, or surrounds, a portion of the shaft 140 and the auger 160. The sleeve 170 includes an outwardly flaring flange by which the sleeve is secured to the end wall 139 of the mixing chamber 130.

A slide gate 174 controls the flow of aggregate from the chamber 76 to the chamber 158. The slide gate 174 is appropriately actuated to move the gate between its open and closed positions.

The slide gate 174 moves on a rack and pinion type linkage, with the rack secured to the bottom of the gate 174 and the pinion secured to the end of a shaft. Such elements are well known and understood. See also FIG. 12, and the discussion in conjunction therewith below.

Aggregate falls to the chamber 158 and to the auger 160 when the slide gate 174 is open. The metering sleeve 170 insures that only a portion of the auger 160 is in direct communication with the aggregate from the chamber 76 and within the chamber 158, and thus meters aggregate to the mixing chamber 130. That is, all of the aggregate which moves to the mixing chamber is transported by the auger 160. Because of the sleeve 170, aggregate cannot flow directly into the mixing chamber 130, but rather must be metered through the sleeve 170 by the auger 160.

With the metering sleeve 170, aggregate in the chamber 158 from the chamber 76 is carefully metered to the mixing chamber 130 by the auger 160. The metering is accomplished by varying the rotational speed of the shaft 140 through control of the motor 142.

A water conduit 200 communicates with the aggregate in the auger housing 162 and adjacent to the auger 160. The water conduit 200 is shown in FIG. 1 and is also shown in FIG. 2. Referring primarily to FIG. 2, it will be noted that a water tank 180 is also secured to the support frame 12. The water tank 180 provides water for the mixing of the aggregate and cementitious material. Water is introduced into the aggregate at the auger 160. This insures that the aggregate is relatively uniformly moistened as the cementitious material is introduced to the aggregate at the mixing chamber 130. A pump 202 in the line or conduit 200 pumps the water from the tank 180 to the auger 160. The pump 202 is also preferably hydraulically actuated.

The pump 202 is preferably a variable speed pump so that the control of the water flow from the tank 180 may be appropriately varied in accordance with the desired amount of water to be mixed with the aggregate and cementitious material.

Figure 11:
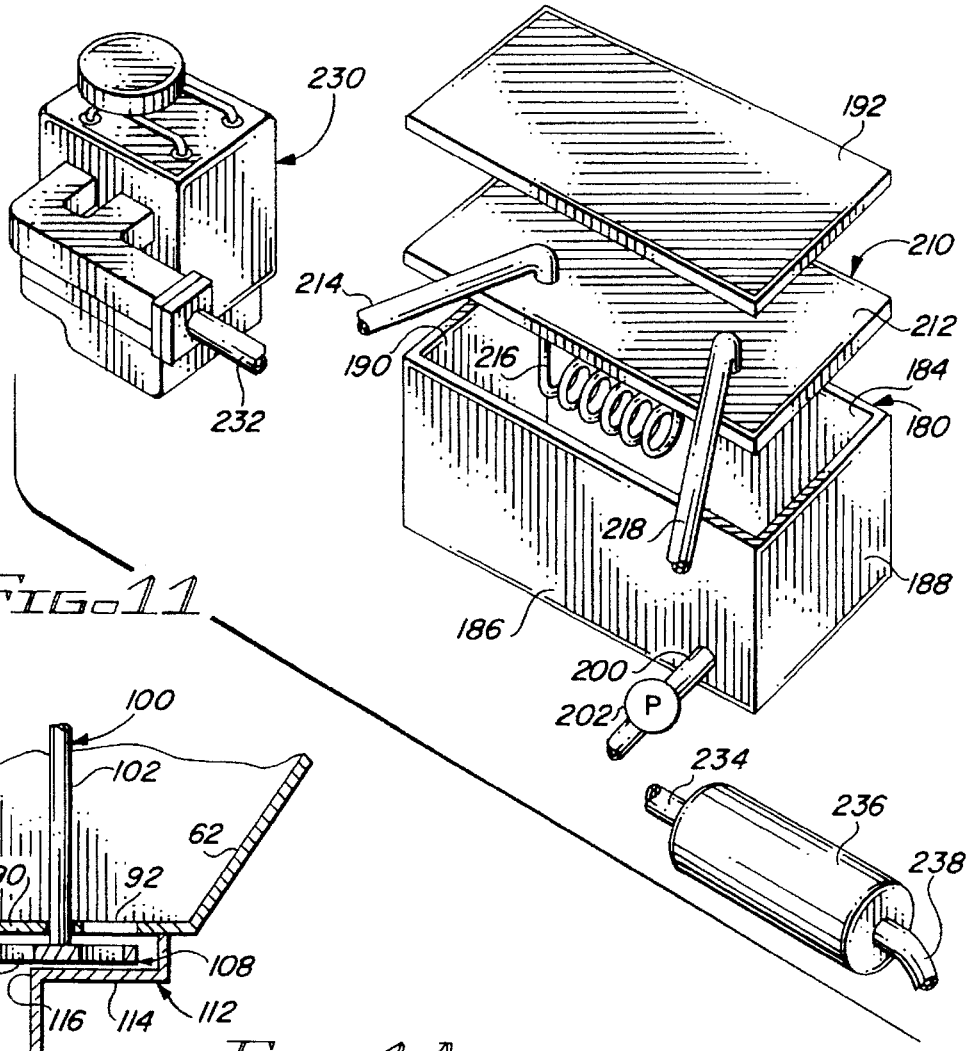
FIG. 11 is an exploded perspective view schematically illustrating two embodiments of a portion of the apparatus of the present invention.

FIG. 11 is a schematic view of the water tank 180 and an engine 230 and associated elements for warming water within the tank 180 during cold weather. Water is warmed by hot exhaust gases from the engine 230.

The engine 230, which is preferably a diesel engine, includes an exhaust pipe 232. The pipe 232 may be connected directly to a pipe 234 and muffler 236 for summer or warm weather operation. The muffler 236 includes an exhaust outlet 238.

In cold weather, the engine exhaust pipe 232 is connected to an insulated exhaust pipe conduit 214, which is part of a cold weather assembly 210. The conduit 214 extends from the pipe 232 to the water tank 180. The exhaust pipe conduit 214 is connected to a coil 216 disposed within the water tank 180.

The water tank 180 is shown as a generally rectangular water tank, which includes a bottom wall, a pair of side walls 184 and 186 which extend upwardly from the bottom wall, and a pair of end walls 188 and 190 which also extend upwardly from the bottom wall and are appropriately secured to the side walls 184 and 186. The tank 180 is closed by a top wall 192 for summer or warm weather operation.

The coil 216 and the conduit 214 are connected to a plate 212. The plate 212 comprises a top wall or cover for the tank 180 during cold weather.

The coil 216 is connected to another conduit 218 on its downstream end. The conduit 218 extends outwardly from the plate 212 and may be connected to the exhaust pipe 234 of the muffler 236.

The conduit or pipe 214, the coil 216, and the conduit or pipe 218 are appropriately secured to the plate 212. The four elements 214, 216, 218, and 212 comprise the cold weather assembly for the water tank 180.

In cold weather the plate 212 replaces the plate 192 and is disposed on the tank 180, and the coil 216 is disposed within the tank 180 and into the water therein.

The coil 216 disposed in the water within the tank 180 provides heat for the water. The water is heated by the hot exhaust gases as they flow through the coil 216 during winter or cold weather operations.

A control panel 250 is shown in FIG. 2 secured to the frame members and disposed adjacent to the engine compartment 50. The control panel 250 includes the desired control elements, such as switches, gages, etc., associated with the engine or motor 220, the hydraulic motors 120 and 142, the vibrators 63 and 69, and the pump 202.

The control of the motor 142 controls the rotational speed of the auger 160 and also the speed of the mixing blades or paddles 150.

The control of the motor 120 controls the quantity of cementitious material which flows from the chamber 74 through the chute 118 and the opening 132 into the mixing chamber 130.

The control of the pump 202 controls the flow of water from the tank 180 to the aggregate feed chamber 158.

It is obvious that not only can the rate of production of the mixed product be controlled through the various motors, but also the slump and the richness of the mixture. The apparatus 10 accordingly comprises a mixer apparatus which is efficient, flexible, and readily and easily transported to a job site.

It will be noted that various hydraulic lines, valves, gages, etc., and other elements have been omitted for purposes of clarity. Such elements are well known and understood in the art.

Figure 12:
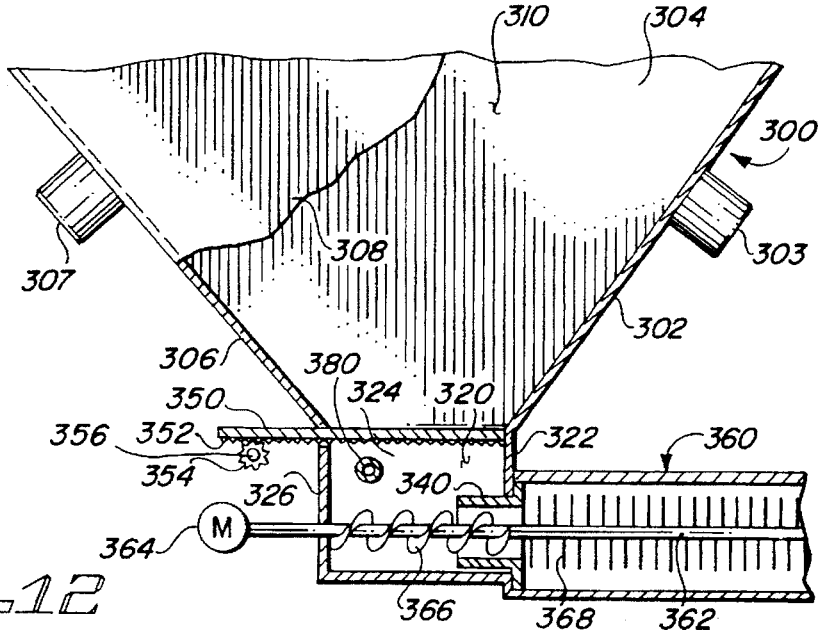
FIG. 12 is a fragmentary side view in partial section of an alternate embodiment of the present invention.

FIG. 12 is a schematic view in partial section of an alternate embodiment 300 of the apparatus of the present invention. The apparatus 300 comprises a single chamber embodiment in which a pre-dried blend of cementitious material and aggregate is disposed. The single chamber apparatus 300 includes a sloping rear wall 302, a sloping side wall 304, a sloping front wall 306, and a sloping side wall 308. The four sloping walls taper inwardly from the top and downwardly. Or, in the alternative, the walls 302, 304, 306, and 308 slope upwardly and outwardly from the bottom. The four walls define a dry mix chamber 310.

A vibrator 303 is appropriately secured to the rear sloping wall 302. Another vibrator 307 is appropriately secured to the front sloping wall 306. The vibrators 303 and 307 help to move the aggregate and cementitious material mixture downwardly.

At the bottom of the dry mix chamber 310 are two walls and a curved bottom housing which define feed chamber 320 to which the dry mix falls and in which is disposed an auger 366. The walls include a rear wall 322, a front wall 326, and a generally V-shaped housing 324 secured to the walls 322 and 326. The bottom of the chamber 320 comprises a generally V-shaped bottom about the auger 366, substantially the same as discussed above for the corresponding elements of the apparatus 10, including a cleanout door. For illustrative purposes, no cleanout door is shown in FIG. 12. The auger 366 will be discussed below. The chamber 320 is substantially the same as discussed above for the corresponding elements of the housing 162 and chamber 158 of the apparatus 10.

A metering sleeve 340 extends into the chamber 320 to limit the flow of aggregate and cementitious material mix to the auger 366 and into the mixing chamber. The metering sleeve 340 is disposed adjacent to a mixing chamber assembly 360. The metering sleeve 340 is disposed about a portion of the auger 366 within the chamber 320 beneath the dry mix chamber 310. The structure of the metering sleeve 340 is substantially the same as discussed above for the corresponding elements of the apparatus 10.

The chamber 310 is separated from the chamber 320 by a slide gate 350. The slide gate 350 is shown extending above the front wall 326 of the chamber 320.

Movement of the slide gate 350 is controlled by a rack and pinion type arrangement. A rack 352 is secured to the bottom of the slide gate 350, and a pinion 354, secured to a shaft 356, engages the rack 352. Rotation of the shaft 356, and accordingly of the pinion 354, moves the slide gate 350 forwardly and rearwardly, to open and close the chamber 320 relative to the chamber 310.

The mixing chamber assembly 360 extends rearwardly from the chamber 320 and from the metering sleeve 340. A shaft 362 extends through the mixing chamber assembly 360 and through the feed chamber 320 to a motor 364. The motor 364 is preferably a hydraulic motor, as with the apparatus 10.

The auger or auger blade 366 is secured to the shaft 362. The auger 366 terminates at the beginning of the mixing chamber assembly 360, and a plurality of mixing blades 368 is secured to the shaft 362 within the mixing chamber assembly 360. The mixing chamber assembly 360, with its mixing blades 368, and also the auger 566, as secured to the shaft 362, are all substantially identical in configuration and operation to the shaft 140, the auger 160, and the mixing blades 150, as discussed above in conjunction with the apparatus 10.

Essentially, the operation of the apparatus 300 is substantially the same as that of the apparatus 10 except that in the apparatus 300 the chamber 310 includes a dry and desired blend of cementitious material and aggregate material, ready for appropriate mixing. Water through a conduit 380 moistens the blend of aggregate and cementitious material in the sump adjacent to the auger 366. The moistened blend then is carried by the auger 366 into the mixing chamber assembly 360, where the mixer blades 368 appropriately mix the blend of aggregate and cementitious material for delivery out of the mixing chamber assembly 360, as desired.

Figure 16:
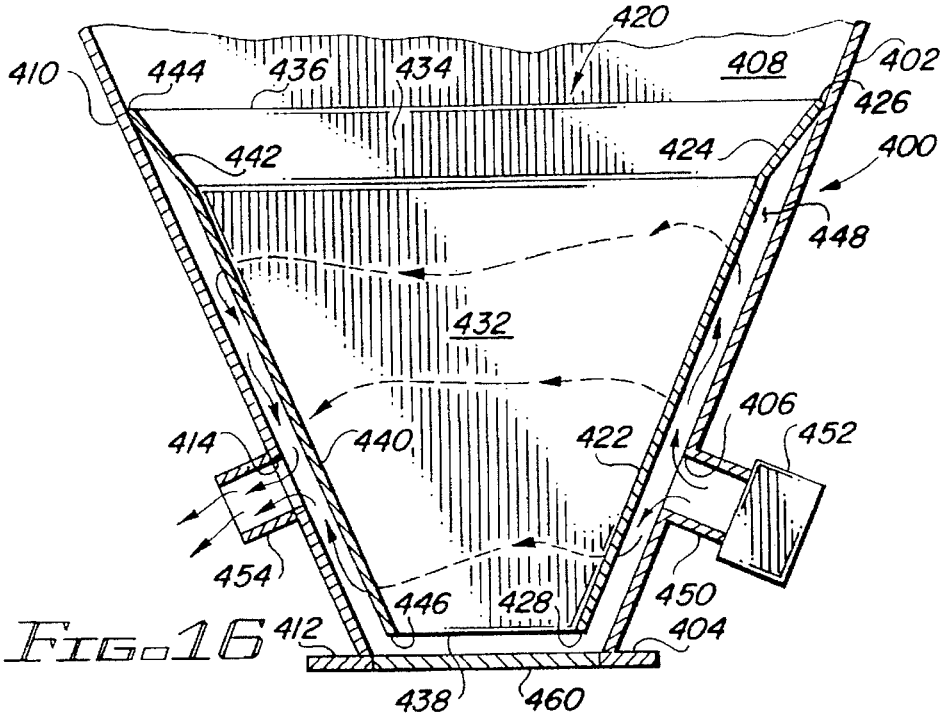
FIG. 16 is a view in partial section through an alternate embodiment of a portion of the present invention.

FIG. 16 comprises a view in partial section through an alternate embodiment of a portion of the apparatus discussed in detail above. An alternate hopper embodiment 400 is shown in FIG. 16. The alternate hopper apparatus 400 includes provisions for heating aggregate material disposed within the hopper assembly 400.

The hopper assembly 400 includes an outer wall assembly and an inner wall assembly spaced apart from the outer wall assembly. A space or chamber is defined between the inner and outer wall assemblies, and heated air is forced through the space or chamber to provide heat for the aggregate material in the hopper assembly. The inner and outer walls, with the spae between them, also form an insulating barrier to help prevent the aggregate from freezing.

The outer wall assembly includes an outer side wall 402. The outer side wall 402 tapers downwardly to a bottom flange 404. The flange 404 extends generally horizontally outwardly, in substantially the same manner as illustrated best in conjunction with FIG. 14 for the side wall 65 (and also for the side wall 67). An aperture 406 extends through the wall 402.

The outer wall assembly includes a front wall 408. A second side wall 410 is also shown, and the wall 410 comprises essentially a mirror image of the wall 402. The side wall 410 includes an outwardly extending bottom flange 412, and an aperture 414 extends through the wall 410. The outer walls are, of course, appropriately secured together, as by welding.

A fourth wall, a rear wall, is not illustrated in FIG. 16, but may be understood from references to the other wall elements discussed above in conjunction with the apparatus 10 and the apparatus 300.

Disposed within the four outer walls is an inner wall assembly 420. The inner wall assembly 420 includes a side wall 422 which is generally parallel to the side wall 402. The side wall 422 includes an upper outwardly sloping portion 424. The slope of the portion 424 is greater than that of the walls 402 and 422. The upper outwardly sloping portion 424 includes a top edge 426 which is disposed against, and is appropriately secured to, the wall 402. The wall 422 also includes a bottom edge 428 which is disposed at the lower portion of the wall 422 and spaced upwardly from a slide gate 460 which extends between the flanges 404 and 412.

A sloping front wall 432 is appropriately secured to the side wall 422 and extends generally parallel to the front outer wall 408. The front wall 432 includes an upper outwardly sloping portion 434 which extends toward the front wall 408. The sloping portion 434 includes a top edge 436 which is appropriately secured, as by welding, to the front outer wall 408. The wall 434 includes a bottom edge 438 which is generally aligned with the bottom edge 428 of the wall 432.

A side wall 440 is substantially a mirror image of the wall 422. The wall 440 includes an upper outwardly sloping portion 442, and a top edge 444 of the sloping portion 442 is appropriately secured, as by welding, to the side wall 410. The side wall 440 includes a bottom edge 446 which is appropriately aligned with the bottom edges 428 and 438.

If desired, there may be a rear inner wall, not shown, but which again may be understood from reference to the previous embodiments, as discussed above. In the absence of a rear inner wall, the inner side walls 422, 424 and 440, 442 may be secured directly to the rear wall of the outer wall assembly.

Material to be mixed is disposed within the inner wall assembly 420.

A hot air chamber 448 is defined between the outer wall elements 402, 408, 410, and an outer front wall, not shown, and the inner wall assembly 420, which includes the wall plates or panels 422, 432, 440, and an inner rear wall, not shown, if a rear inner wall is desired. If the inner wall assembly includes only three walls, then heated air is moved only on three sides of the material within the inner wall assembly 420.

A conduit 450 is appropriately secured to the wall 402 at the aperture 406. The conduit 450 is in turn secured to an appropriate source of heat 452.

A conduit 454 is disposed about the aperture 414, and is appropriately secured to the wall 410. The conduit 454 comprises an exhaust conduit for exhausting the hot air flowing into the chamber 448 from the heat source 452. The hot air flows through the chamber 448 to warm the aggregate disposed within the inner wall assembly 420 and to protect the aggregate against freezing.

Figure 17:
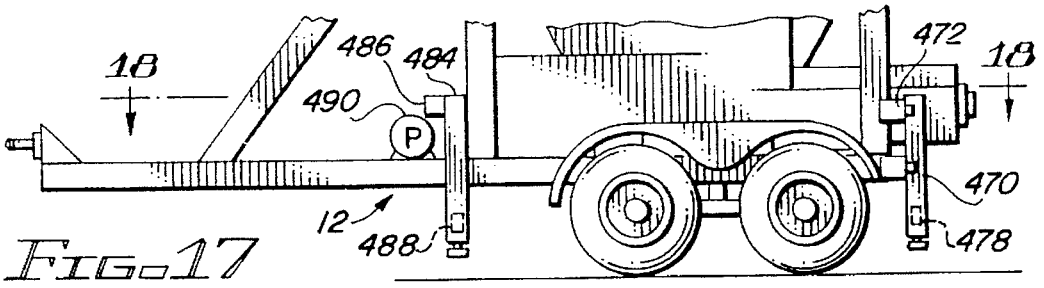
FIG. 17 is a side view of a portion of the present invention illustrating additional components.

FIG. 17 comprises a side view of the lower portion of the support frame 12 illustrating the addition of hydraulic jacks which may be used to raise the entire apparatus upwardly from the ground or surface on which it is disposed to a desired height to accommodate a cement pump, etc. The use of hydraulic jacks is an alternative to, or an addition to, the leveler jacks illustrated in FIG. 1 and discussed above.

Figure 18:
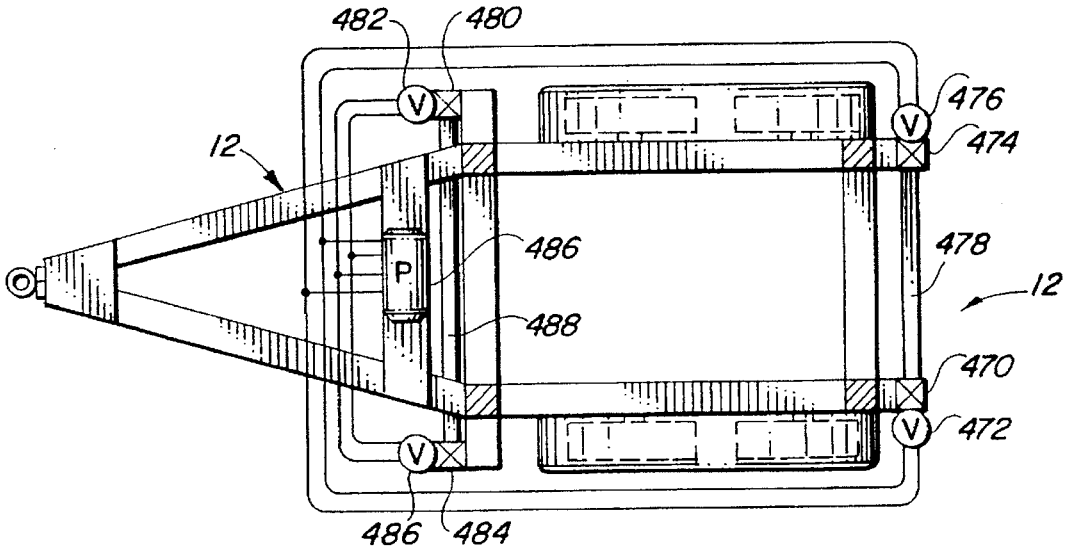
FIG. 18 is a schematic representation of the apparatus of FIG. 17 taken generally along line 18—18 of FIG. 17.

FIG. 18 is a view taken generally along line 18—18 of FIG. 17, schematically illustrating the layout of the hydraulic jack elements and their associated hydraulic lines, etc.

Four hydraulic cylinders or jacks 470, 474, 480, and 484, are schematically illustrated in FIGS. 17 and 18. Associated with each hydraulic cylinder or jack assembly is a hydraulic control valve. A hydraulic control valve 472 is shown associated with the cylinder 470, a control valve 476 is shown associated with the cylinder 474, a valve 482 is shown associated with the cylinder 480, and a valve 486 is shown associated with the cylinder 484.

Two hydraulic lines for pressure or supply and return, are schematically illustrated as extending from a pump 486 to each of the valves. The setting of each valve connects the hydraulic lines as appropriate.

For helping to stabilize the hydraulic elements and the support frame 12, a support tube 478 is shown extending between the cylinders 470 and 474, and a support tube 488 is shown extending between the cylinders 480 and 484.

The operation of hydraulic cylinders is well known and understood in the art. The hydraulic cylinders essentially include a cylinder and a piston movable in the cylinder, with a piston rod or leg secured to the piston and extending outwardly from the cylinder. The piston and its rod or leg are movable in response to hydraulic pressure in the cylinder.

The four separate valves allow maximum flexibility in controlling the height and the leveling of the frame 12, and the elements associated therewith, regardless of the terrain on which the apparatus is disposed.

It will be noted that the terms "aggregate" and "cementitious material" have been used throughout the specification. Obviously, other materials may be used in addition to or in place thereof.

Moreover, while hydraulic power is discussed, obviously electrical power may be used, if desired. The use of hydraulic power makes the apparatus self sufficient, without relying on electric power for electric motors.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Mixing apparatus, comprising, in combination:

a first chamber for holding a quantity of first material to be mixed;

a second chamber beneath the first chamber for receiving the first material from the first chamber;

a third chamber for holding a quantity of second material to be mixed with the first material;

a partition disposed between the first and third chambers;

mixing chamber means for receiving material from the first and third chambers and for mixing the first and second materials, including a mixing chamber, and a plurality of mixing blades in the mixing chamber for mixing the first and second materials;

means for transporting the first material from the first chamber to the mixing chamber, including an auger blade disposed in the second chamber;

a metering sleeve disposed about a portion of the auger in the second chamber adjacent to the mixing chamber for insuring that only a portion of the auger blade is in direct communication with the material in the second chamber;

means for controlling the speed of the auger blade for metering the first material to the mixing chamber; and vane feeder means in the third chamber adjacent to the partition for metering the second material to the mixing chamber means, including a vane feeder having a rotatable shaft and a rotor secured to the shaft and openings in the rotor through which the second material moves as the shaft and the rotor rotate, and a plurality of arms secured to and rotatable with the shaft and spring ends secured to the arms remote from the shaft which bend as the spring ends contact the partition and straighten as the arms rotate away from the partition to provide a maximum length for the arms for agitating the second material.

2. The apparatus of claim 1 which includes means for metering the second material to the mixing chamber means.

3. The apparatus of claim 1 in which the means for transporting the first material to the mixing chamber includes a rotatable shaft and the auger blade is secured to the rotatable shaft.

4. The apparatus of claim 3 in which the rotatable shaft to which the auger blade is secured extends into the mixing chamber of the mixing chamber means and the plurality of mixing blades are secured to the shaft in the mixing chamber.

5. The apparatus of claim 1 in which the mixing chamber means further includes a plurality of paddles secured to the plurality of mixing blades for aerating the mixture of the first and second materials.

6. The apparatus of claim 1 which further includes means for heating the first material in the first chamber.

7. The apparatus of claim 6 in which the means for heating the first chamber includes a outer wall assembly, an inner wall assembly spaced apart form the outer wall assembly, and a hot air chamber defined between the outer wall assembly and the inner wall assembly, and the first chamber comprises the inner wall assembly.

8. The apparatus of claim 7 which further includes means for providing a source of heated air to the hot air chamber.

9. Portable apparatus for mixing material comprising, in combination:

a support frame;

wheel means secured to the support frame for moving the support frame;

hopper means secured to the support frame for holding materials to be mixed, including a first chamber for holding a quantity of first material, and a second chamber for holding a quantity of second material to be mixed with the first material;

a partition between the first and second chambers:

a mixing chamber for receiving the first and second materials for mixing;

means for mixing the first and second materials in the mixing chamber including a rotatable shaft, and a plurality of blades secured to and rotatable with the shaft means for metering a quantity of the second material to the mixing chamber, including a vane feeder disposed in the second chamber adjacent to the partition, a chute between the vane feeder and the mixing through which the second material falls from the vane feeder to the mixing chamber, a shaft secured to the vane feeder.

a motor connected to the shaft for rotating the shaft for controlling the quantity of second material through the vane feeder to the chute and the mixing chamber an arm secured to the shaft for agitating the second material as the shaft rotates and a spring end on the arm for bending as the arm rotates with the shaft adjacent to the partition and straightening as the arm rotates away from the partition; and means for metering a quantity of the first material to the mixing chamber, including an auger secured to the rotatable shaft adjacent to the mixing chamber for transporting a quantity of the first material to the mixing chamber, and a metering sleeve disposed over at least a portion of the auger adjacent to the mixing chamber for insuring that only a portion of the auger is in direct communication with the first material from the first chamber.

10. The apparatus of claim 9 which further includes a tank for holding a liquid to be mixed with the first and second materials.

11. The apparatus of claim 10 in which the tank includes means for heating the liquid.

12. The apparatus of claim 9 which further includes means for lifting the support frame.

13. The apparatus of claim 12 in which the means for lifting the support frame includes a plurality of jacks secured to the support frame.

* * * * *